US005500901A

United States Patent [19]

Geraci et al.

[11] Patent Number: 5,500,901

[45] Date of Patent: Mar. 19, 1996

[54] FREQUENCY RESPONSE ADJUSTING DEVICE

[75] Inventors: Michael P. Geraci, Lino Lakes; Donald R. Hagen; Arman E. Sundquist, both of Brooklyn Park, all of Minn.

[73] Assignee: Resistance Technology, Inc., Arden Hills, Minn.

[21] Appl. No.: 287,720

[22] Filed: Aug. 9, 1994

Related U.S. Application Data

[63] Continuation of Ser. No. 839,484, Feb. 20, 1992, abandoned.

[51] Int. Cl.[6] ..... H04R 25/00

[52] U.S. Cl. ..... 381/68.2; 381/60; 381/68

[58] Field of Search ..... 381/60, 68.2, 68.4, 381/68, 69, 69.2, 68.6, 68.7; 73/585; 439/816, 818, 819; 429/96, 97, 98, 99, 100; 361/772, 774

[56] References Cited

U.S. PATENT DOCUMENTS

| | | | |
|---|---|---|---|
| 1,632,112 | 6/1927 | Bramming | 439/816 |
| 3,693,136 | 9/1972 | Appleton | 439/818 |
| 4,548,082 | 10/1985 | Engebretson et al. | 381/68.2 |
| 4,598,177 | 7/1986 | McGroarty et al. | 179/107 E |
| 4,632,478 | 12/1986 | Kozai et al. | 439/816 |
| 4,835,833 | 6/1989 | McDonald | 29/525 |
| 4,961,230 | 10/1990 | Rising | 381/68 |
| 5,111,419 | 5/1992 | Morley et al. | 381/68 |

FOREIGN PATENT DOCUMENTS

| | | | |
|---|---|---|---|
| 0673551 | 3/1990 | Switzerland | 381/68 |
| 1241532 | 6/1986 | U.S.S.R. | 439/819 |

*Primary Examiner*—Curtis Kuntz
*Assistant Examiner*—Huyen D. Ie
*Attorney, Agent, or Firm*—Kinney & Lange

[57] ABSTRACT

A device for adjusting the frequency response of a hearing aid is provided. The device includes a module capable of being releasably secured substantially within the opening of the hearing aid such that the hearing aid is capable of remaining in the user's ear during programming. A mechanism for delivering electrical current and frequency response adjusting signals from a programming station to the device is connected to the device. The device further includes a mechanism for delivering electrical current from the module to the hearing aid thereby providing power to the hearing aid and a mechanism for delivering frequency response adjusting signals from the module to the hearing aid thereby allowing the frequency response of the hearing aid to be adjusted.

10 Claims, 4 Drawing Sheets

FREQUENCY RESPONSE ADJUSTING DEVICE

This is a File Wrapper Continuation of application Ser. No. 07/839,484, filed Feb. 20, 1992 is now abandoned.

BACKGROUND OF THE INVENTION

The present invention relates to a device for adjusting the frequency response in hearing aids, and, in particular, to a device for adjusting the frequency response in hearing aids while the hearing aid remains in the ear of the user.

Acceptable performance of a hearing aid device requires an audiologist to adjust the hearing aid device so that the frequency response of circuitry of the hearing aid device conforms to the needs of the hearing aid user. Proper frequency response in a hearing aid's circuitry permits a user to discriminate between tones at which words are spoken and tones from a noisy background.

To achieve proper frequency response, an audiologist fine-tunes frequency response adjustments to a degree required by an individual hearing aid user. Typically, the fine-tuning occurs by trial and error and requires many fine-tuning adjustment cycles.

Each fine-tuning adjustment cycle is time consuming and burdensome for both the audiologist and the hearing aid user because the hearing aid must be removed from the user's ear and reinserted for each adjustment. While removed from the user's ear, the audiologist manually adjusts the frequency response. The audiologist then inserts the hearing aid back into the user's ear to determine whether the frequency response has been adjusted correctly.

SUMMARY OF THE INVENTION

The present invention includes a device for adjusting a circuitry of a hearing aid to a desired frequency response. The device includes a module that is releasably secured substantially within a battery compartment of the hearing aid. The module is secured in the battery compartment after the battery is removed. The module permits a hearing aid user to retain the hearing aid in his ear while the audiologist adjusts the frequency response.

The module includes a mechanism for delivering electrical current from a remote programming station to the module and then to the hearing aid thereby providing power to the hearing aid. The module additionally includes a mechanism for delivering frequency response adjusting signals from the remote programming station to the module and then to the hearing aid circuitry thereby allowing the frequency response of the hearing aid to be adjusted. This module allows for dynamic or active participation by the user to choose the best response. The ability to immediately discriminate selections is made possible.

DETAILED DESCRIPTION OF THE PREFERRED EMBODIMENTS

Figure 1:
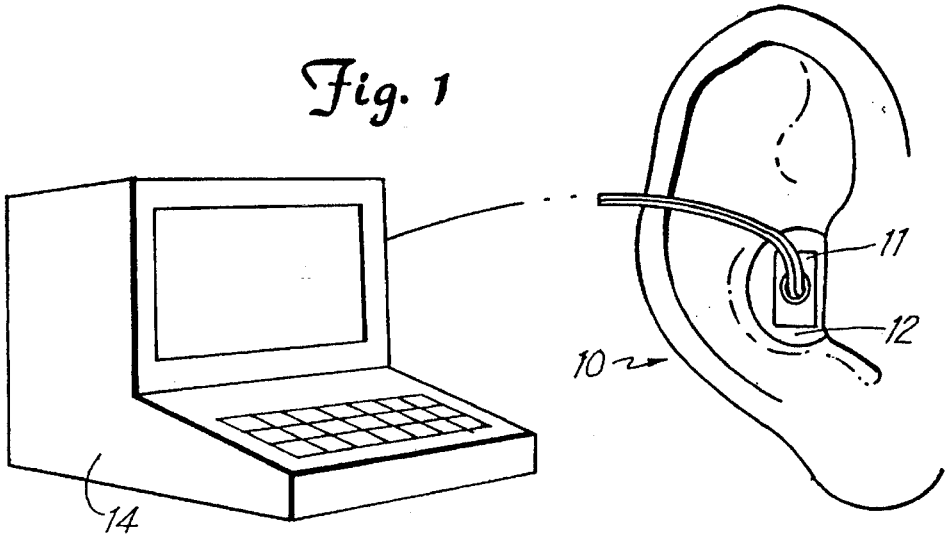
FIG. 1 is a perspective view of the frequency response adjusting device of the present invention releasably secured in a hearing aid which has been placed in a user's ear with a programming station connected thereto.

A device for adjusting hearing aid circuitry to a desired frequency response, indicated generally in FIG. 1, at 10, includes a releasably secured module 11, contained substantially within a hearing aid 12 and connected to a remote programming station 14.

The releasably secured module 11 of the device 10 of the present invention is of a size and shape that enables the module 11 to attach to the hearing aid 12. Specifically, the module 11 attaches within a battery compartment 22 of the hearing aid 12 when the battery (not shown) is not in the compartment 22 and when the battery door (not shown) is open or removed from the hearing aid 12, as illustrated in FIG. 3.

Figure 2:
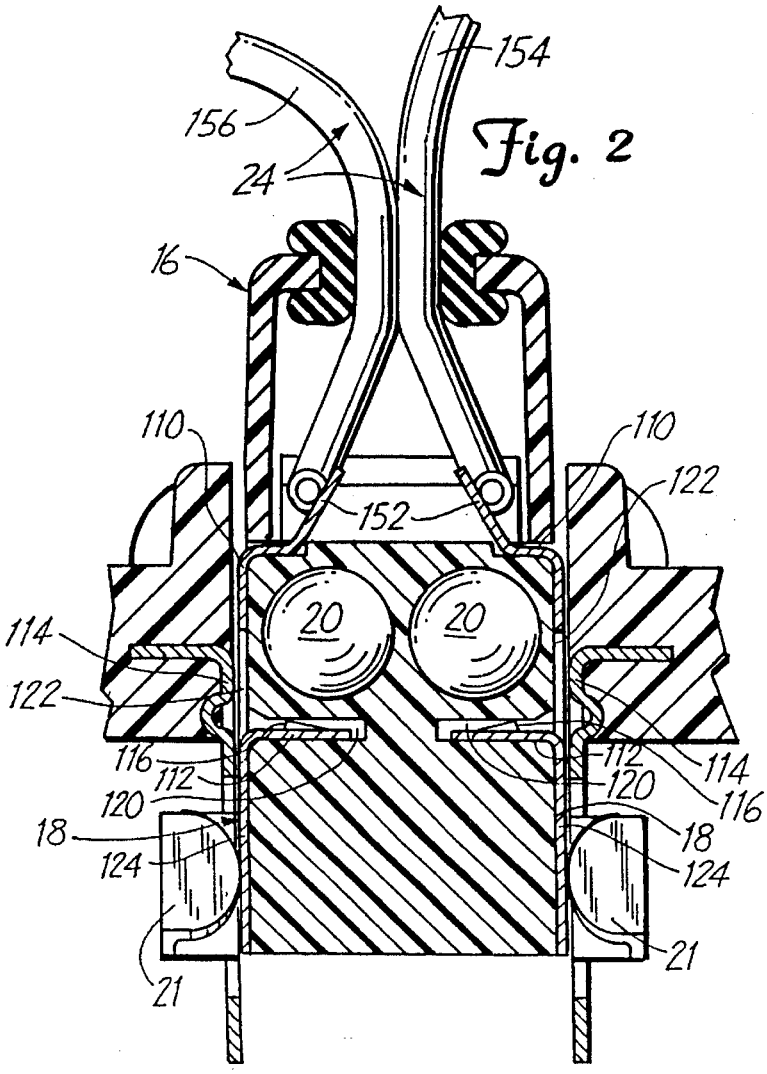
FIG. 2 is a sectional view of the device taken along line 3—3 in FIG. 3 subsequent to being inserted into the opening of the hearing aid.

The releasably secured module 11 of the device 10 of the present invention includes a housing 16, a pair of contact plates 18 secured to the housing 16, a pair of contact probes 20 partially enclosed by the housing 16 and a plurality of leads 24 as illustrated in FIG. 2. The plurality of leads 24 convey either electric current or frequency response adjusting signals from the remote programming station 14 to either the pair of contact probes 20 or the pair of contact plates 18.

The housing 16 of the module 11 is substantially hollow and is of a size and symmetry that permits the housing 16 to fit within the battery compartment 22 of the hearing aid 12. The battery compartment 22 is disposed within a faceplate 26 of the hearing aid 12 as illustrated in FIG. 3. The faceplate 26 of the hearing aid 12 faces outwardly from a user's ear when the hearing aid 12 is inserted into a user's ear. The battery compartment 22, being disposed in the faceplate 26, also faces outwardly. When installed in the battery compartment 22, the housing 16 of the releasably secured module 11 also faces outwardly from the user's ear.

Figure 3:
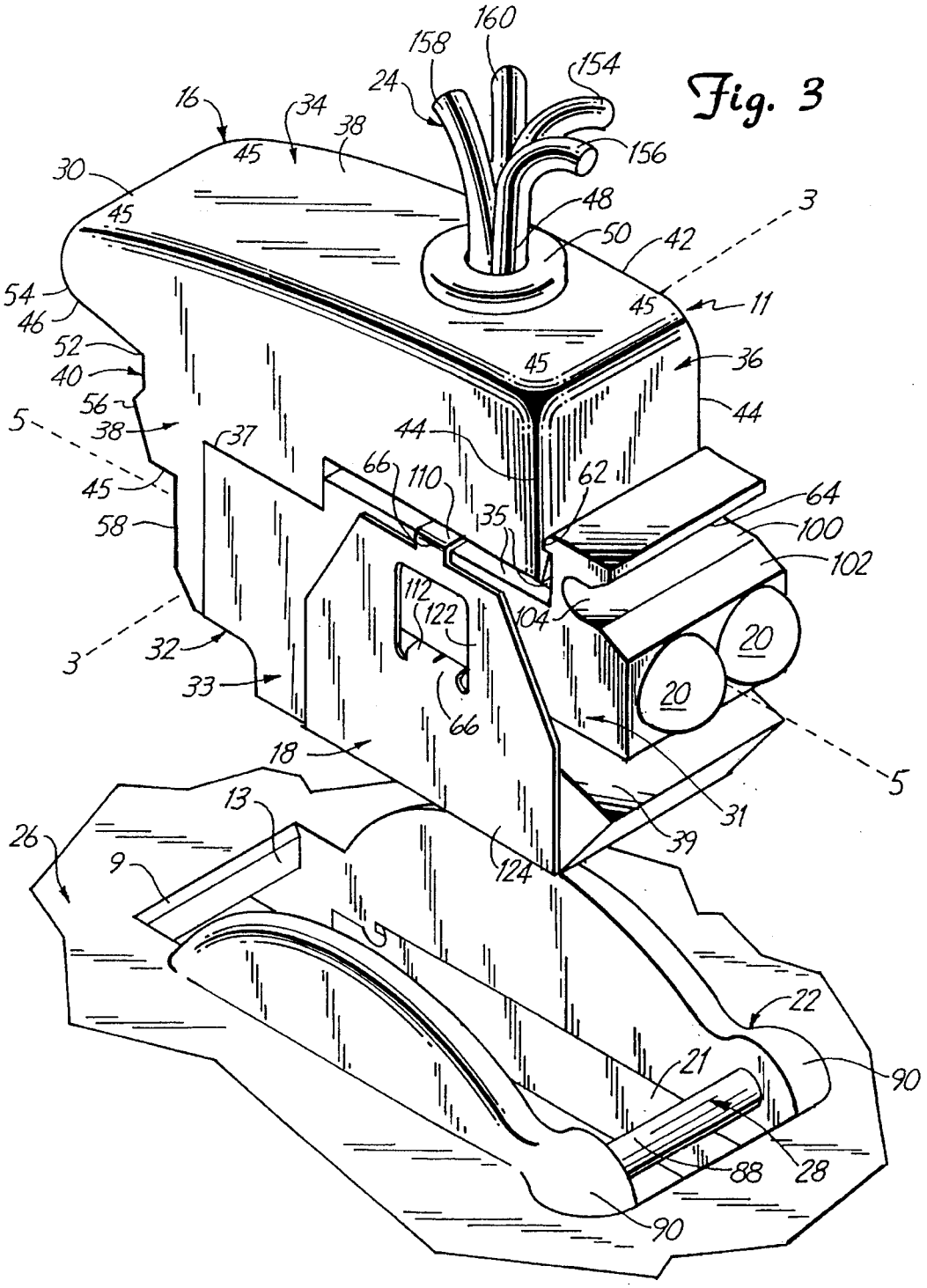
FIG. 3 is another perspective view of the device of the present invention prior to insertion into an opening of the hearing aid.
Figure 4:
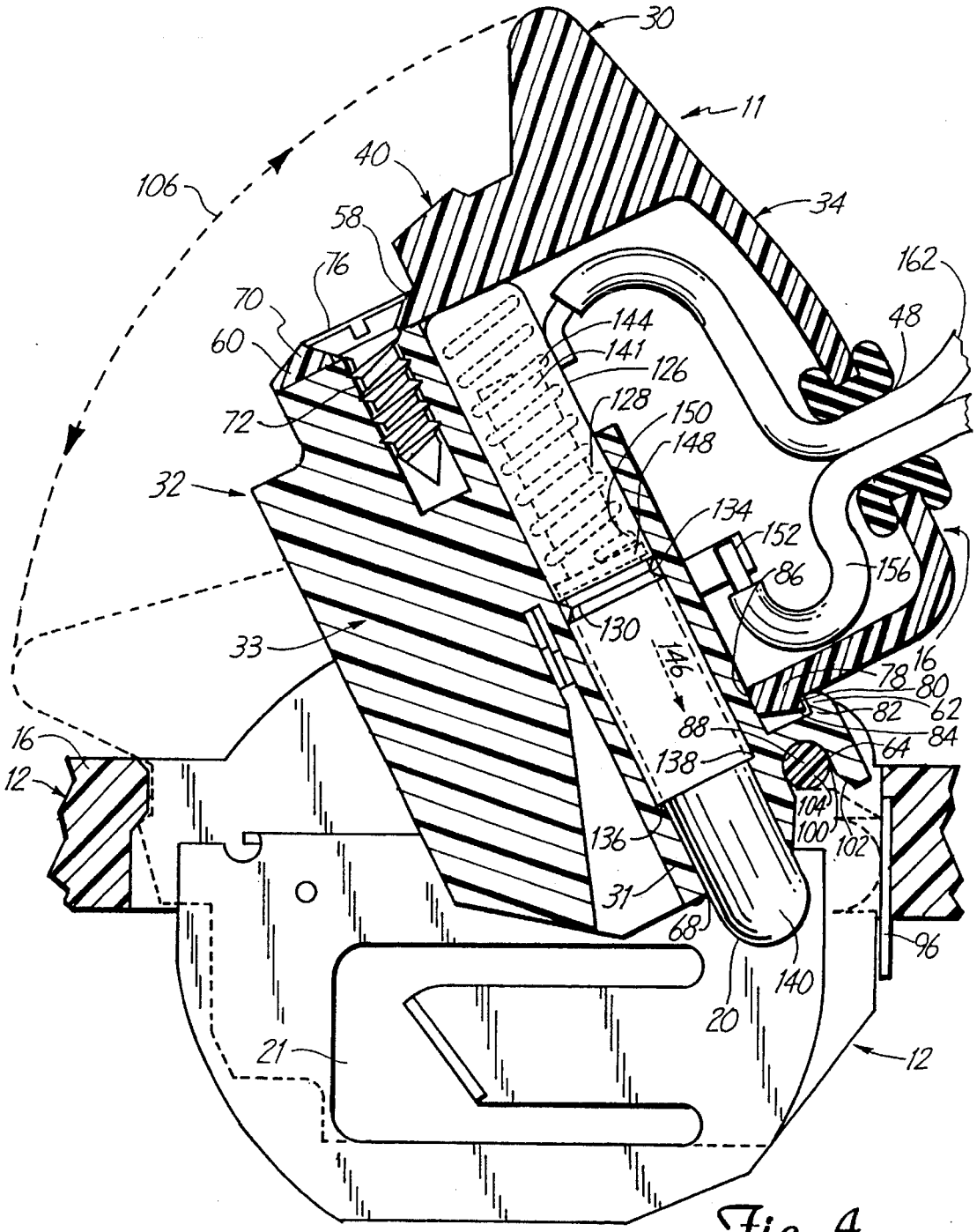
FIG. 4 is a sectional view of the device illustrating the device being inserted into the opening of the hearing aid with the position of the device during frequency response adjusting illustrated in phantom.

The battery compartment 22 of the hearing aid 12 includes a side 9 having a shoulder 13 and a hinge 28 10 opposing the side 9 as illustrated in FIG. 3. The shoulder 13 and hinge 28 releasably secure the housing 16 to the battery compartment 22. The battery compartment 22 also includes a pair of battery contacts 21 illustrated in FIG. 3. When the housing 16 of the module 11 is secured in the battery compartment 22, the pair of battery contacts 21 contact the pair of contact plates 18 secured to the housing 16. The battery compartment 22 additionally includes a probe contact 96 as best illustrated in FIG. 4. The probe contact 96 is disposed to contact the pair of contact probes 20 of the releasably secured module 11 when the module is secured in the battery compartment 22 of the hearing aid 12.

The housing 16 of the module 11 includes an upper housing portion 30 and a lower housing portion 32 that is secured to the upper housing portion 30, as illustrated in FIG. 3. The upper housing portion 30 and lower housing portion 32 are shaped to shelter the pair of contact probes 20 and the plurality of leads 24 as well as to hold up the pair of contact plates 18. The upper housing portion 30 and lower housing portion 32 are secured in a manner to promote ease of servicing.

The upper housing portion 30 includes an upper top section 34, an upper front section 36, a pair of opposing upper side sections 38 and an upper back section 40. The upper front section 36, the pair of opposing upper side sections 38, and the upper back section 40 each meet the upper top section 34 at an edge 42 bordering the upper top section 34. Each member of the pair of opposing upper side sections 38 meets the upper front section 36 at a pair of opposing edges 44. Each member of the pair of opposing upper side sections 38 meets the upper back section 40 at a pair of opposing edges 46. The pair of opposing edges 44 and the pair of opposing edges 46 meet the edge 42 bordering the upper top section 34 to form four corners 45.

The upper top section 34 of the upper housing 30 includes a lead aperture 48 and an annular ring 50 surrounding the lead aperture 48. The lead aperture 48 permits the plurality of leads 24 to pass from the contact probes 20 inside the housing 16 to the outside of the housing 16. The annular ring 50 is raised in a manner to provide support for the plurality of leads 24. The annular ring 50 also eliminates sharp edges that could cut and otherwise damage the plurality of leads 24.

The upper front section 36 and opposing upper side sections 38 must be deep enough to provide adequate space for housing the plurality of leads 24. The opposing upper side section 38 must also be of a length to enclose the plurality of leads 24.

The upper back section 40 includes an indented portion 52, an upper shoulder portion 54 and a lower shoulder portion 56. The indented portion 52 is disposed between and integral with the upper shoulder portion 54 and the lower shoulder portion 56. The upper shoulder portion 54 extends outwardly to a greater extent than the lower shoulder portion 56. The indented portion 52, upper shoulder portion 54 and lower shoulder portion 56 of the upper back section 40 are sized and disposed to fit within the battery compartment 22 of the hearing aid 12. The upper back section 40 additionally includes a fastening portion 58. The fastening portion 58 is integral with and disposed below the lower shoulder portion 56.

The releasably secured module 11 is secured to the battery compartment 22 of the hearing aid 12 when the indented portion 52 of the upper back section 40 of the upper housing 30 is engaged within the battery compartment 22. Specifically, the indented portion 52 is engaged by the shoulder 13 of the side 9 within the battery compartment 22 of the hearing aid 12. The indented portion 52 locks the shoulder 13 of the battery compartment 22 between the upper shoulder portion 54 and the lower shoulder portion 56 of the upper back section 38 of the housing 16.

The lower housing portion 32 includes a probe housing section 31 and a bottom section 33 integral with and disposed below the probe housing section 31. The probe housing section 31 is separated from the upper front section 36 of the upper housing portion 30 by a slot 35. The slot 35 also separates the pair of opposing upper side sections 38 from the probe housing section 31. The opposing upper side sections 38 do contact the bottom section 33 of the lower housing portion 32 along an edge 37 as illustrated in FIG. 3.

The probe housing section 31 is separated from the bottom section 33 of the lower housing portion 32 by a wedge-shaped notch 39. The wedge-shaped notch 39 permits the probe housing 31 to shelter the contact probes 20 and permits the bottom section 33 to fit within the battery compartment 22.

The probe housing section 31 of the lower housing portion 32 includes a latch mechanism 62 for attaching the lower housing portion 32 to the upper housing portion 30 and a hinge holder portion 64 for receiving the hinge 28 of the battery compartment 22 of the hearing aid 12 as illustrated in FIG. 3. The probe housing section 31 also includes an attaching means 66 for attaching the pair of contact plates 18 to the lower housing portion 32 and a pair of orifices 68 for exposing the pair of contact probes 20 to the outside of the housing 16 as illustrated in FIG. 3. The probe housing section 31 additionally includes a lower housing shoulder 136 for engaging the pair of contact probes 20 within the probe housing section 31 as illustrated in FIG. 4.

The latch mechanism 62 of the probe housing section 31 of the lower housing portion 32 includes a first latch element 78 and a first latch shoulder 80 that integrally extends downward from the first latch element 78 as illustrated in FIG. 4. The latch mechanism 62 also includes a second latch element 82 that includes a second latch shoulder 84 that integrally extends upward from the second latch element 82. The first latch element 78 further includes a latch camming surface 86 to guide the second latch shoulder 84 of the second latch element 82 past the first latch shoulder 80 on the first latch element 78. When the latch mechanism 62 is engaged, the first latch shoulder 80 contacts and engages the second latch shoulder 84.

The hinge holder portion 64 of the lower housing portion 32 attaches the hinge 28 of the battery compartment 22 of the hearing aid 12 to the housing 16. The hinge 28 includes a hinge pin 88 and a pair of hinge supports 90 that secure the hinge pin 88 to the battery compartment 22, as illustrated in FIG. 3.

The releasably secured module 11 of the device 10 of the present invention is secured to the hearing aid 12 by the hinge holder portion 64 adapted to receive the hinge pin 88 of the hinge 28 within the battery compartment 22 of the hearing aid 12. The hinge-holder portion 64 is adjacent to and integral with the second latch element 82 of the latch mechanism 62 as best illustrated in FIG. 4. The hinge holder portion 64 of the probe housing section 31 of the lower housing portion 32 includes first and second pin guiding surfaces 100 and 102 respectively, adapted to guide and receive the hinge pin 88. The first pin guiding surface 100 encloses a circular pin receiving portion 104 having a diameter approximately equal to the diameter of the hinge pin 88. The circular pin receiving portion 104 receives the hinge pin 88. The circular pin receiving portion 104 cooperates with the hinge pin 88 to permit hinge-movement of the module 11 along an arc 106 relative to the faceplate 26 of the hearing aid 12 as illustrated in FIG. 4. Once the hinge pin 88 has been secured within the circular pin receiving portion 104 of the lower housing portion 32, the releasably secured module 11 is movable about an arc of about 45° as best illustrated at 106 in FIG. 4.

To release the latch mechanism 62, the hinge pin 88 of the hearing aid 12 must first be removed from the circular pin receiving portion 104. To remove the latch mechanism 62, the hinge holder portion 64 is urged substantially downward. The downward movement of the hinge holder portion 64 causes the second latch shoulder 84 to move substantially upward in the direction opposite the direction moved by the hinge holder portion 64. Upward movement of the second latch shoulder 84 causes the second latch shoulder 84 to move away from the first latch shoulder 80 so that the first latch shoulder 80 can be moved to separate from the second latch shoulder 84.

The bottom section 33 of the lower housing portion 32 includes a flange portion 60 that attaches the lower housing portion 32 to the upper back section 40 of the upper housing portion 30 as illustrated in FIG. 4. The flange portion 60 includes a flange 70 having a connecting aperture 72, as best illustrated in FIG. 4. The flange 70 abuts the fastening portion 58 of the upper back section 40 of the upper housing portion 30. The connecting aperture 72 also extends through the fastening portion 58 of the upper housing portion 30. The connecting aperture 72 receives a screw 76 that extends through the fastening portion 58 and the flange portion 70. The connecting aperture 72 is most preferably threaded.

To disconnect the upper housing 30 from the lower housing 32 of the module 11 for servicing or maintenance, the screw 76 must first be removed from the connecting aperture 72. Upon removal of the screw 76, the latch mechanism 62 can be released.

The action of releasing the latch mechanism 62 in conjunction with the removal of the aperture screw 76 effectively releases the upper housing portion 30 from the lower housing portion 32. However, the hinge-holder portion 64 can prevent the release. The hinge-holder portion 64 cannot be moved downward without removing the hinge pin 88 from the circular pin receiving portion 104. Thus, the presence of the hinge pin 88 in the circular pin receiving portion 104 effectively prevents the release of the latch mechanism 62. Consequently, by impeding downward movement, once the hinge pin 88 has been positioned in the pin receiving portion 104 of the releasably secured module 11, accidental disconnection of the upper housing 30 from the lower housing 32 will not occur.

The pair of contact plates 18 are attached to the lower housing portion 32 by attaching means 66 on the probe housing section 31 as best illustrated in FIG. 3. The attaching means 66 include an upper tab 110 and a lower tab 112. The upper tab 110 is disposed within the slot 35 that separates the upper housing portion 30 from the lower housing portion 32. The upper tab 110 is bent to an angle that is approximately perpendicular to the contact plate 18 and is integral with the contact plate 18.

The lower tab 112 of the contact plate 18 is also integral to the contact plate 18 and is bent approximately perpendicular to the contact plate 18. The lower tab 112 rests within the wedge-shaped notch 39 separating the bottom section 33 from the probe housing section 31 of the lower housing portion 32. The lower tab 112 also includes a projection 116, as illustrated in FIG. 2. The projection 116 is disposed on a top section 120 of the lower tab 112. The projection 116 aids in securing the lower tab 112 to the lower housing 32.

The contact plate 18 also includes a solid plate 124 and an opening 122 that is surrounded by the solid plate 124 as illustrated in FIG. 3. The solid plate 124 extends the length of the lower housing portion 32. The solid plate 124 of the contact plate 18 is made of a conductive material. Typically, the solid plate 124 is made of copper. The opening 122 surrounded by the solid plate 124 of the battery contact 18 corresponds to contact points 114 within the battery compartment 22 of the hearing aid 12 not used by the module 11 as illustrated in FIG. 2. The opening 122 permits the contact plate 18 to contact the battery contact 21 without contacting contact points 114.

Each member of the pair of contact probes 20 partially enclosed within the probe housing section 31 of the housing 16 includes a probe housing 126 conductively connected to a dome-shaped probe head 140, as illustrated in FIG. 4. The probe housing 126 is enclosed within a probe aperture 128. The probe housing 126 includes an annular indentation 130.

The lower housing shoulder 136 acts upon a probe housing shoulder 138 of the probe housing 126 and serves as a stop to keep the probe housing 126 within the probe aperture 128.

Figure 5:
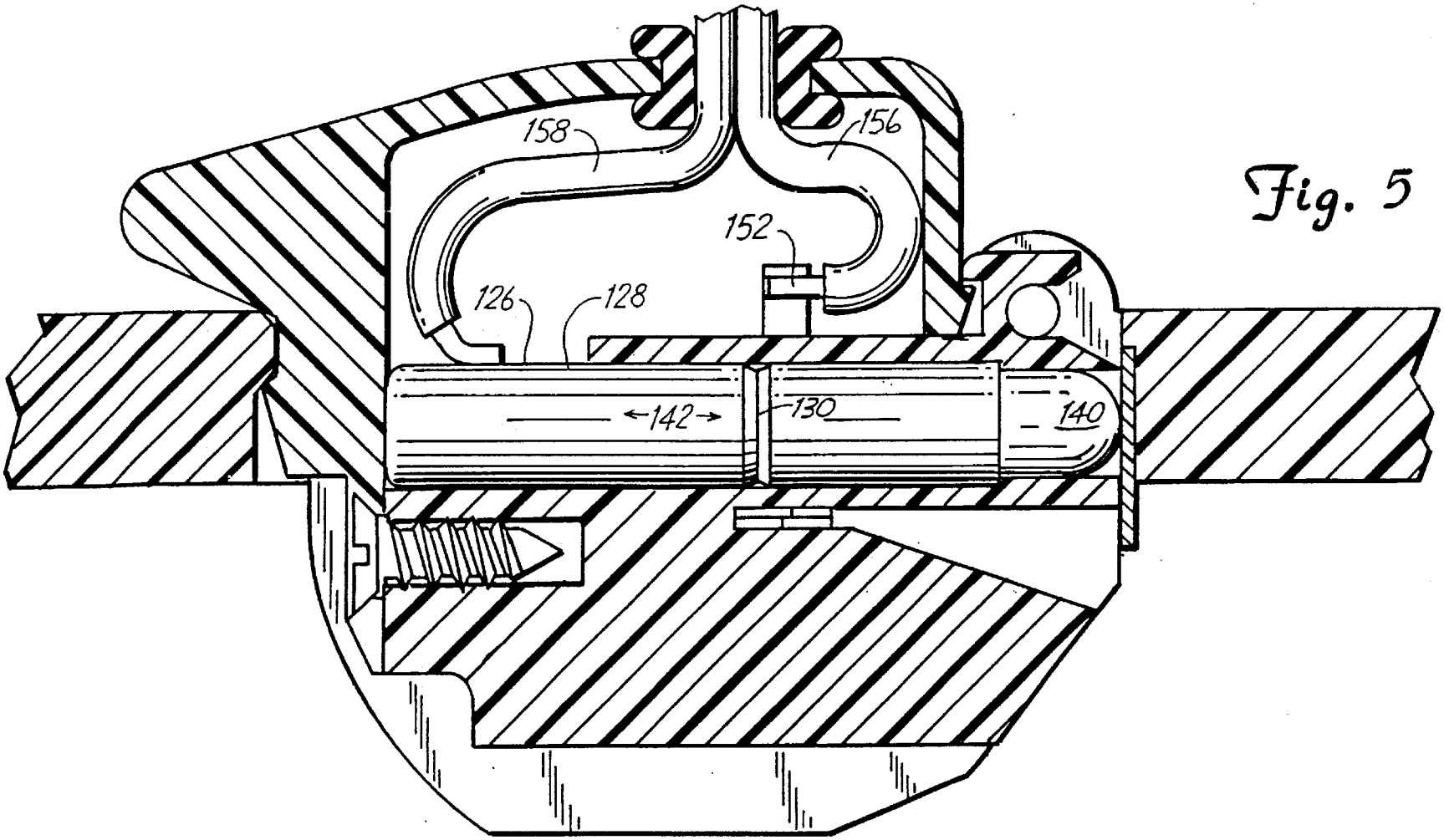
FIG. 5 is a sectional view of the device taken along 5—5 in FIG. 3 within the opening of the hearing aid.

The dome-shaped probe head 140 includes a probe segment 141 attached to the probe-head 140. The probe housing 126, conductively connected to the dome-shaped probe head 140, encloses the probe segment 141 of the probe head 140. The probe head 140 is movable along a longitudinal axis 142 of the probe housing 126, as indicated in FIG. 5. A coil spring 144, positioned in the probe housing 126, encloses the probe segment 141. The coil spring 144 biases the dome-shaped probe head 140 to move along the longitudinal axis 142 and away from the probe housing 126 in the direction of the arrow 146, as illustrated in FIG. 4.

The coil spring 144 includes an end 150 and a base 148 disposed on the end 150. The base 148 has a diameter greater than that of the probe head 140 and greater than that of the probe housing 126 at the annular indentation 130. The base 148 is disposed between the annular indentation 130 and the coils of the coil spring 144. Thus, as the coil spring 144 urges the probe head 140 in the direction of arrow 146, the base 148 is stopped by the annular projection 130 and prevents the probe head 140 from detaching from the probe housing 126.

The plurality of leads 24 deliver electric current from the remote programming station 14 to the hearing aid 12 by contacting the contact plates 18 at the upper tab 110 as illustrated in FIG. 2. Specifically, the upper tab 110 of the contact plates 18 includes a conductive lead 152, integral to and extending upwardly from the upper tab 110, as illustrated in FIG. 2. The plurality of leads contact the conductive lead 152 of the upper tab 110.

The plurality of leads 24 includes a first lead 154 and a second lead 156 as illustrated in FIG. 2. The leads 154 and 156 deliver electric current from the remote programming station 14 to the pair of contact plates 18 of the module 11 through the conductive lead 152 of the upper tab 110. Electric current is delivered to the hearing aid 12 when the contact plates 18 contact the pair of battery contacts 21 located in the battery compartment 22 of the faceplate 16 of the hearing aid 12 as illustrated in FIG. 3.

The plurality of leads 24 also includes leads 158 and 160 for delivering frequency response adjusting signals from the remote programming station 14 to the pair of contact probes 20 of the releasably secured module 11. Specifically, the leads 158 and 160 contact the respective probe housing 126 of each probe of the pair of contact probes 20. The pair of contact probes 20 contact the probe contact 96 disposed in the battery compartment 22 of the faceplate 16 of the hearing 12.

The plurality of leads 24 connected to the programming station 114 extend through the lead aperture 48. In the preferred embodiment, there are four leads in the plurality of leads 24 extending through the lead aperture 48 within the upper top section 34 of the upper housing portion 30. The four leads include the leads 154 and 156 that deliver electric current to a respective contact plate 18 via the conductive lead 152. The four leads 24 additionally include the third lead 158 and the fourth lead 160 that contact a respective contact probe 20 to deliver frequency response adjusting signals to the module 11 from the programming station 14.

In order to adjust the frequency response of the hearing aid 12 according to the present invention, the hearing aid 12 is first removed from the ear of a user. A door (not shown) covering the battery compartment 22 is rotated upward and then removed to expose a battery. The battery is then removed from the battery compartment 22 to make room for the module 11.

To insert the releasably secured module 11 into the battery compartment 22, the hinge pin 88 is positioned in the circular pin receiving portion 104 of the module 11. The module 11 is then pivotally rotated downward about the hinge pin 88 in the direction of arc 106 until stopped by the upper shoulder portion 54 of the upper back side 40 of the upper housing 30 as best illustrated in FIG. 2. The indented portion 52 contacts the shoulder 13 on the side 9 of the battery compartment 22. The module 11 is pressed downward until the lower shoulder portion 56 of the module 11 is below the shoulder 13 of the battery compartment 22, so that the module 11 is releasably secured within the battery compartment 22. The upper shoulder portion 54 of the upper housing portion 30 of the module 11 prevents the module 11 from being inserted too far into the battery compartment 22. The indented portion 52 of the upper back section 40 of the upper housing portion 30 is shaped to receive the shoulder 13 of the battery compartment 22.

After the releasably secured module 11 has been inserted and rotated downward in the direction of arc 106, the pair of contact plates 18 of the module 11 contact the battery contacts 21 of the hearing aid 12, as best illustrated in FIG. 3. This connection allows electrical current to travel from the programming station 14 through the module 11 to the hearing aid 12. In addition, the pair of contact probes 20 contact the corresponding probe contact 96 in the battery compartment 22, as illustrated in FIG. 5. The pair of contact probes 20 transfer frequency response adjusting signals from the programming station 14 though the module 11 into the hearing aid 12.

At this point, the hearing aid 12 now attached to the module 11 can be placed back into the user's ear. Adjustments to the frequency response of the hearing aid 12 can be made while the user communicates with the audiologist as to when the tones are best adjusted.

Utilization of the present device 10 to adjust the frequency response of hearing aids permits the audiologist to adjust the frequency response while the hearing aid 12 remains in the ear of the user. Once the correct adjustment has been made, the module 11 is simply removed from the hearing aid 12 and a battery is reinserted. To remove the device 10, the module 11 is rotated upward along the arc 106, as illustrated in FIG. 4. The module 11 is then lifted off the hinge pin 88 of the hearing aid 12 by releasing the hinge pin 88 from the circular pin receiving portion 104. The amount of time needed to correctly adjust the frequency response is significantly decreased and the need for time consuming trial and error adjustments are eliminated.

Although the present invention has been described with reference to preferred embodiments workers skilled in the art will recognize that changes may be made in form and detail without departing from the spirit and scope of the invention.

What is claimed is:

1. A device for use with a programming station for adjusting frequency response of a hearing aid, the hearing aid including an opening for receiving a battery and a battery door operable with the opening for releasably maintaining the battery in the opening when the battery door is closed, the device comprising:

a module removably connected to the hearing aid for releasably securing the module substantially within the opening when the battery is not in the opening and when the battery door is open, such that the hearing aid remains in a user's ear during adjustment of the frequency response, the module includes a first housing releasably secured to a second housing, the second housing being hingedly and removably connected to the hearing aid;

means for delivering electrical current from the module to the hearing aid thereby providing power to the hearing aid, the means for delivering electrical current being positioned on the second housing and accessible by removal of the first housing; and means for delivering frequency response adjusting signals from the module to the hearing aid thereby allowing the frequency response of the hearing aid to be adjusted, the means for delivering frequency response being positioned on the second housing and accessible by removal of the first housing.

2. The device of claim 1 wherein the hearing aid includes a first shoulder extending into the opening, wherein the module includes a second shoulder extending outward from a side of the module and wherein the second shoulder is press-fitted past the first shoulder thereby releasably locking the second shoulder under the first shoulder and thereby releasably locking the module in the opening of the hearing aid.

3. The device of claim 1 wherein the means for delivering electrical current from the module to the hearing aid comprises a plurality of plates attached to the module, each of the plates conductively contacting a current contact positioned within the opening of the hearing aid.

4. The device of claim 3, wherein each of the plates is mounted on the second housing.

5. The device of claim 1 wherein the means for delivering frequency response adjusting signals from the module to the hearing aid comprises a plurality of elongated probes, each probe being attached to the module, along a longitudinal axis thereof, and conductively contacting a frequency response contact positioned within the opening of the hearing aid.

6. The device of claim 5 wherein each probe include a biasing mechanism operable along the longitudinal axis of the probe to bias the probe away from the module and towards the respective frequency response contact.

7. The device of claim 5, wherein each probe is mounted on the second housing.

8. The device of claim 1, wherein the module is movable about an arc of approximately 45°.

9. The device of claim 1, wherein the first housing is positioned substantially outside of the opening when the second housing is positioned substantially within the opening.

10. The device of claim 1, wherein the module is separate and distinct from the battery door.

* * * * *